US008640410B2

(12) United States Patent
Bergeron

(10) Patent No.: US 8,640,410 B2
(45) Date of Patent: Feb. 4, 2014

(54) LOAD BEARING WALL SYSTEM

(71) Applicant: Yvan Bergeron, Edmonton (CA)

(72) Inventor: Yvan Bergeron, Edmonton (CA)

( * ) Notice: Subject to any disclaimer, the term of this patent is extended or adjusted under 35 U.S.C. 154(b) by 0 days.

(21) Appl. No.: 13/754,523

(22) Filed: Jan. 30, 2013

(65) Prior Publication Data

US 2013/0192155 A1 Aug. 1, 2013

(51) Int. Cl.
*E04B 2/18* (2006.01)
*E04C 3/30* (2006.01)

(52) U.S. Cl.
USPC ..... 52/270; 52/284; 52/309.7; 52/309.16; 52/592.1; 52/787.1; 52/790.1; 52/292

(58) Field of Classification Search
USPC ..... 52/309.7, 309.9, 309.11, 309.16, 270, 52/284, 580, 588.1, 591.2, 592.1, 503, 52/790.1, 787.1, 793.1, 794.1, 292, 847, 52/800.1
See application file for complete search history.

(56) References Cited

U.S. PATENT DOCUMENTS

| | | | | | |
|---|---|---|---|---|---|
| 416,097 | A | | 11/1889 | Dyar | |
| 3,313,073 | A | * | 4/1967 | Mathews | 52/309.2 |
| 3,372,520 | A | * | 3/1968 | Hensel | 52/489.1 |
| 3,386,218 | A | * | 6/1968 | Scott | 52/309.11 |
| 3,760,548 | A | * | 9/1973 | Sauer et al. | 52/592.1 |
| 3,785,103 | A | * | 1/1974 | Turner | 52/309.11 |
| 4,183,393 | A | * | 1/1980 | Bailey | 160/232 |
| 4,186,539 | A | * | 2/1980 | Harmon et al. | 52/580 |
| 4,416,097 | A | * | 11/1983 | Weir | 52/220.2 |
| 4,550,543 | A | * | 11/1985 | Valenzano | 52/309.7 |
| 4,644,724 | A | * | 2/1987 | Schijf | 52/588.1 |
| 5,077,948 | A | * | 1/1992 | Olson et al. | 52/309.9 |
| 5,277,011 | A | * | 1/1994 | Serrano Martin | 52/588.1 |
| 5,497,589 | A | * | 3/1996 | Porter | 52/309.7 |
| 5,577,363 | A | * | 11/1996 | Tate et al. | 52/784.15 |
| 5,638,651 | A | * | 6/1997 | Ford | 52/309.7 |
| 5,718,276 | A | * | 2/1998 | Rekret | 160/201 |
| 5,934,040 | A | * | 8/1999 | Chen | 52/784.13 |
| 6,513,862 | B2 | * | 2/2003 | Dodson et al. | 296/155 |
| 6,591,558 | B1 | * | 7/2003 | De Zen | 52/91.3 |
| 6,658,808 | B1 | * | 12/2003 | Doherty et al. | 52/580 |
| 2004/0060245 | A1 | * | 4/2004 | Loblick et al. | 52/79.5 |
| 2005/0257486 | A1 | * | 11/2005 | Ching | 52/720.1 |
| 2007/0062146 | A1 | * | 3/2007 | Van Dijk et al. | 52/580 |
| 2010/0212241 | A1 | * | 8/2010 | Holroyd | 52/309.4 |

* cited by examiner

*Primary Examiner* — Robert Canfield
(74) *Attorney, Agent, or Firm* — Christensen O'Connor Johnson Kindness PLLC

(57) ABSTRACT

A load bearing wall system which is made from a plurality of interlocking panels. Each panel includes a hollow panel body having a first end, a second end, and an interior cavity. A male coupling is positioned at the first end and a female coupling is positioned at the second end. The female coupling is capable of interlocking with the male coupling of another of the plurality of interlocking panels. The male coupling houses a structural stud that extends for the entire vertical height of the hollow panel body. The interior cavity of the hollow panel body is filled with insulation. Interlocking panels intended for straight sections have the female coupling opposed to the male coupling in a linear alignment. Interlocking panels intended for a corner or change in direction have the hollow panel body bent so that the female coupling is angularly offset from the male coupling.

15 Claims, 10 Drawing Sheets

LOAD BEARING WALL SYSTEM

FIELD

There is described a wall system that was developed for use in building basement walls, where the wall system is subjected to bearing loads from floors built above and lateral loads from backfill. It is now appreciated that the wall system could be used in for walls above the basement level.

BACKGROUND

There are numerous examples of insulated panel wall systems. Few of those wall systems are capable of withstanding bearing loads and lateral loads experienced when used for basement walls. What is required is a wall system with improved ability to withstand bearing loads from floors above and lateral loads from backfill.

SUMMARY

There is provided a load bearing wall system which is made from a plurality of interlocking panels. Each panel includes a hollow panel body having a first end, a second end, and an interior cavity. A male coupling is positioned at the first end and a female coupling is positioned at the second end. The female coupling is capable of interlocking with the male coupling of another of the plurality of interlocking panels. The panel body has a vertical height to suit the installation application, a minimum thickness of 4 inches, and a horizontal length determined by desired structural stud spacing with a maximum horizontal length of 24 inches. The male coupling houses a structural stud that extends for the entire vertical height of the panel body. The interior cavity of the hollow panel body is filled with insulation. Interlocking panels intended for straight sections have the female coupling opposed to the male coupling in a linear alignment. Interlocking panels intended for a corner or change in direction have the hollow panel body bent so that the female coupling is angularly offset from the male coupling.

Beneficial results are seen when the interior cavity of the hollow panel body has at least one transverse internal cross-brace. The cross-brace provides additional support to the panel.

Further beneficial results are seen when inwardly extending stops are positioned between the male coupling and the interior cavity to preclude movement of the structural stud.

The panels may be made of any suitable building material, however beneficial results have been seen when the panel body is made of a polymer plastic. It is preferred that the materials are capable of being recycled.

When building a basement wall, there is firstly determined a desired size of panel body. In terms of structural load bearing capacity, the most important dimension is the width. The width selected is typically is 12 inches, 18 inches or 24 inches. When the panel bodies are interlocked to form a wall, this places the structural stud at the desired interval of 12 inches, 18 inches or 24 inches. The positioning of the structural stud dictates the load bearing capacity. The closer the placement of the structural studs, the greater the load capacity of the resulting wall to both vertical bearing loads and lateral loads.

It is preferred that the engagement between the male coupling and the female coupling is waterproof. This can be accomplished with a serrated engagement, as will hereinafter be further described. However, it may alternatively be accomplished by the application of an external coating after installation and before backfilling. These external coatings are known in the industry and will not be further described.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
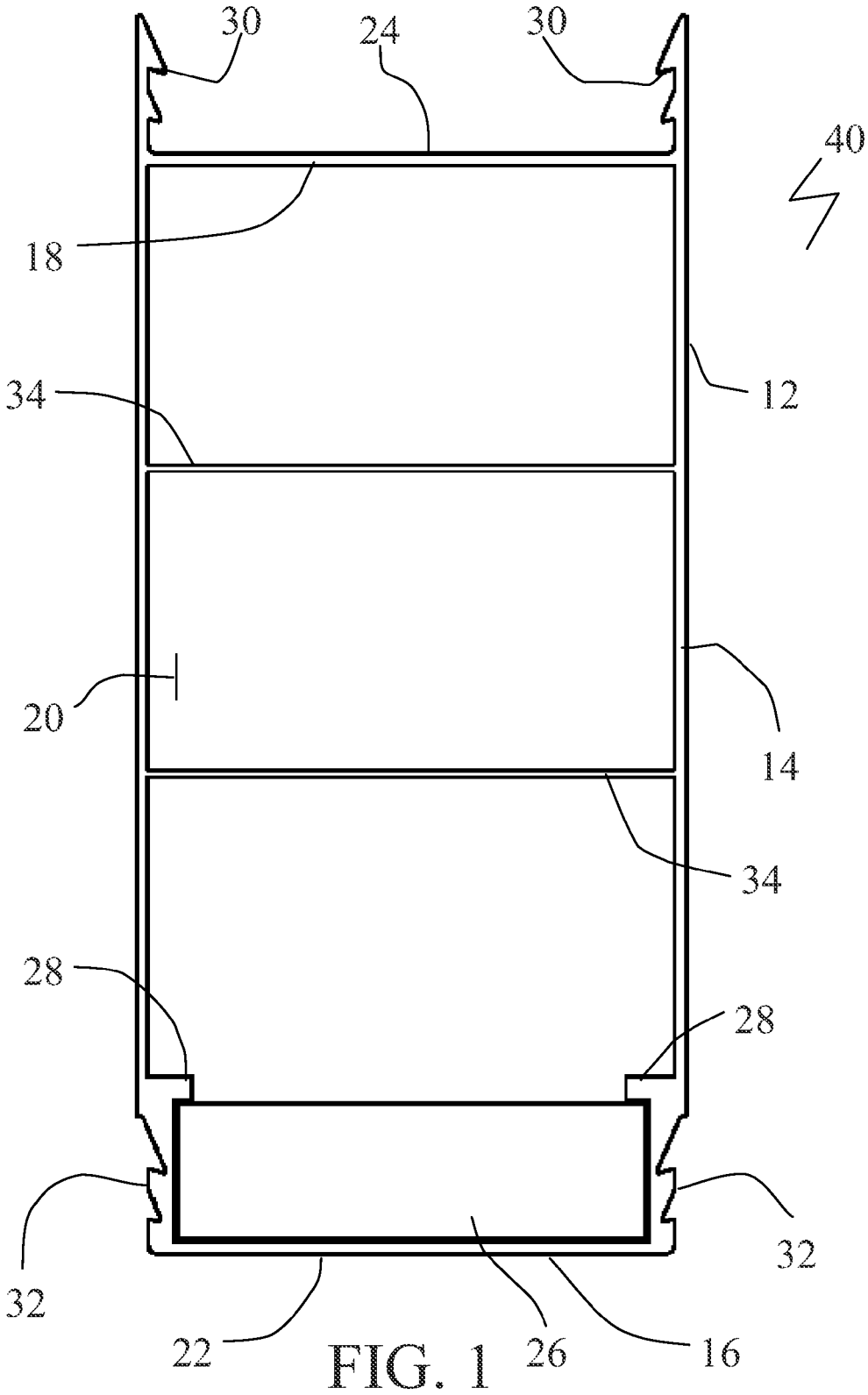
FIG. 1 is an interlocking panel with male coupling and female coupling in opposed linear alignment.
Figure 2:
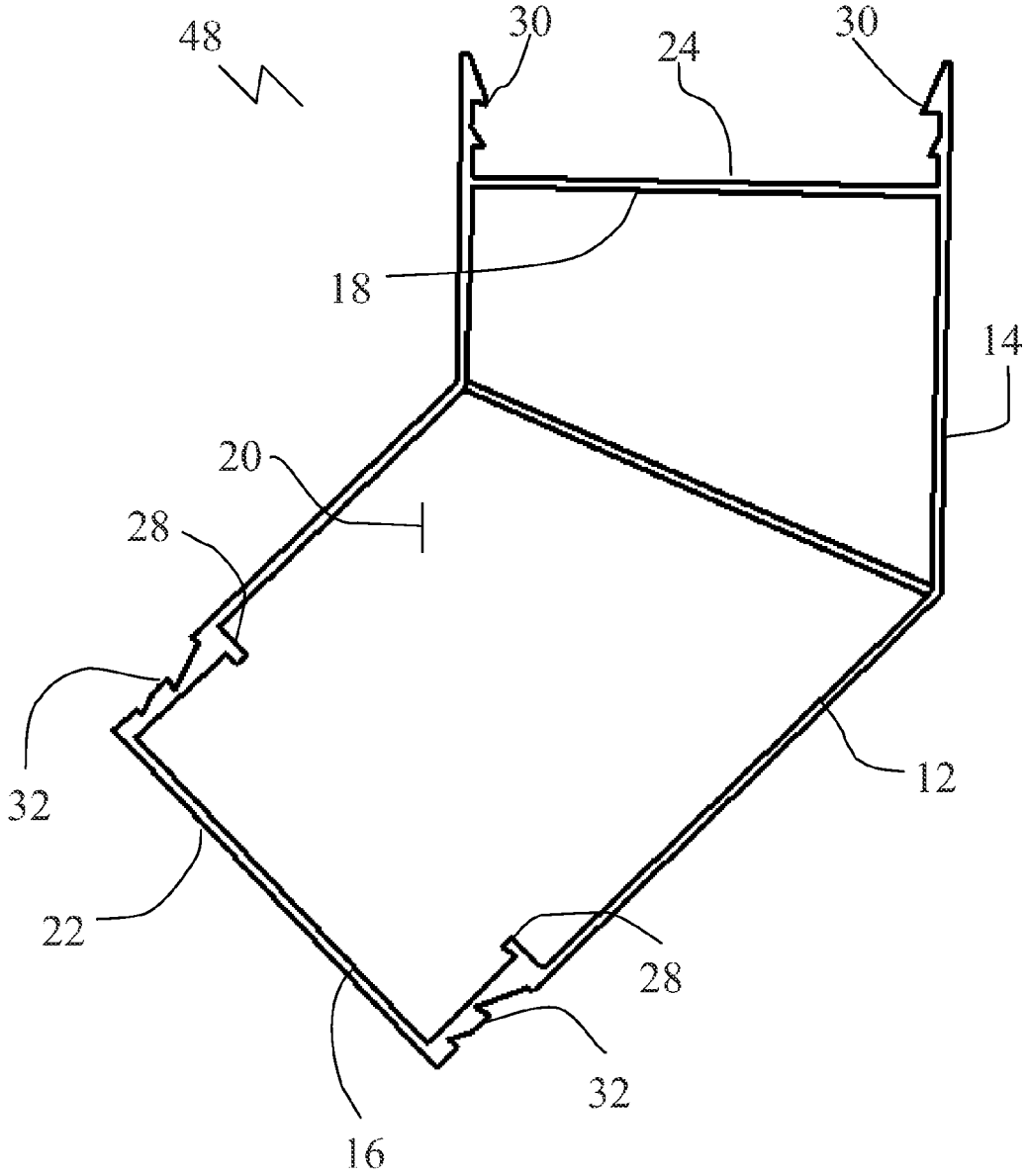
FIG. 2 is an interlocking panel with a 45 degree bend, placing the male coupling and the female coupling in angularly offset relation.

A load bearing wall system generally identified by reference numeral 10, will now be described with reference to FIGS. 1 through 11.

Figure 7:
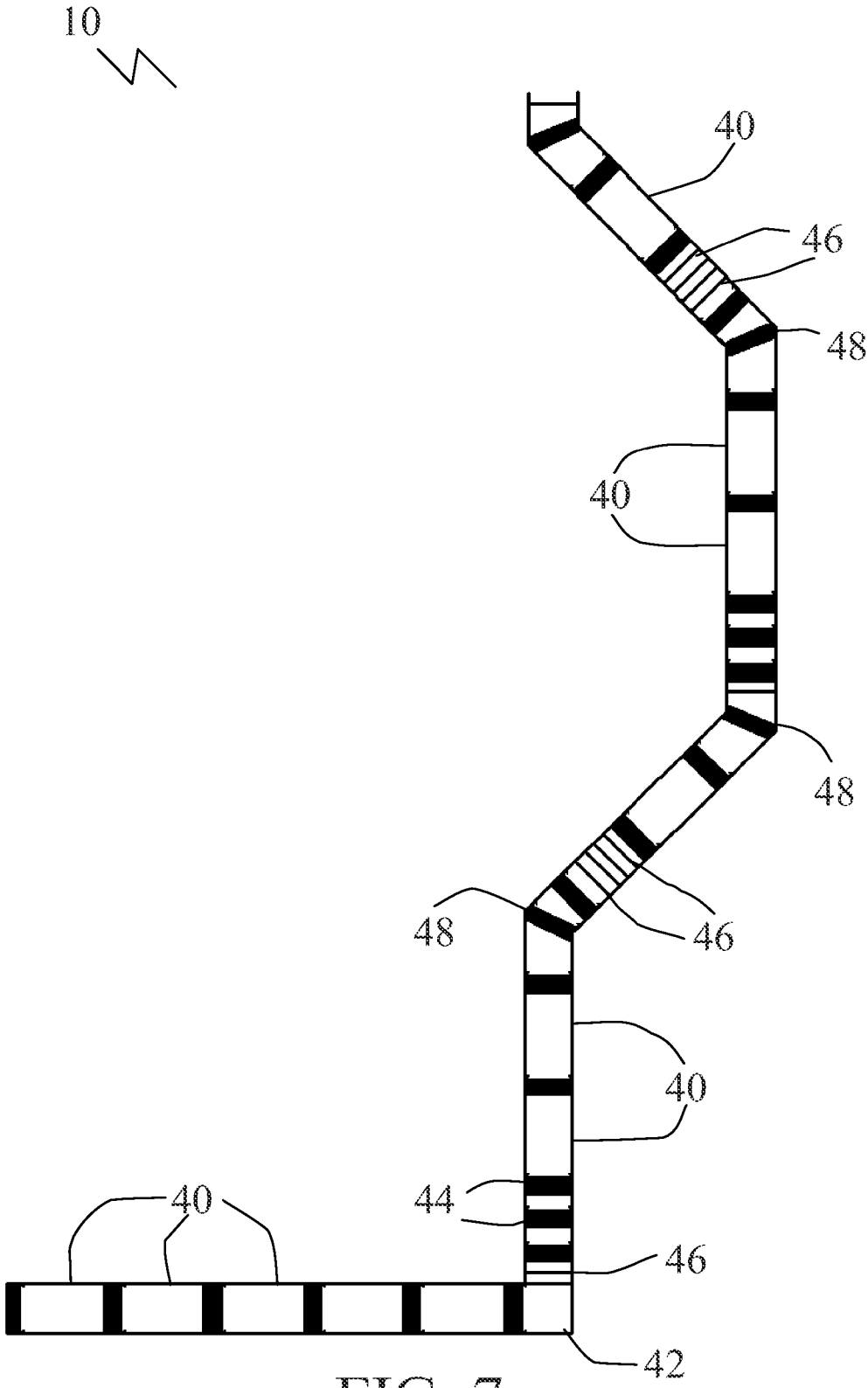
FIG. 7 is a top plan view of a wall section constructed using a combination of interlocking panels illustrated in FIG. 1 through FIG. 5.

Structure and Relationship of Parts:

Referring to FIG. 7, a load bearing wall system 10 includes a plurality of interlocking panels 12. Referring to FIG. 1, each panel 12 includes a hollow panel body 14 that has a first end 16, a second end 18 and an interior cavity 20. Hollow panel body 14 is preferably made of polymer plastic, however different materials may be used. Panels 12 are connected together in an interlocking fashion using male couplings 22 and female couplings 24. Each panel 12 has male coupling 22 at first end 16 and female coupling 24 at second end 18. Male coupling 22 houses a structural stud 26 that extends the entire vertical height of panel body 12. Inwardly extending stops 28 are positioned between male coupling 22 and interior cavity 20 to preclude movement of structural stud 26. Structural stud 26 may be of any dimensions, however most wall systems 10 will call for structural studs measuring 2×6, 2×8, or 2×10. Female coupling 24 is capable of interlocking with male coupling 22 of another of interlocking panels 12. Interior cavity 20 of hollow panel body 14 is filled with insulation. Different types of insulation may be utilized with wall system 10, however it is preferred that foam insulation be used. Cross-braces 34 may be utilized to provide additional structural support to panels 12 and help to prevent panels 12 from collapsing inwards.

Female coupling 24 has a plurality of inwardly directed serrated engagements 30 that correspond to a plurality of outwardly directed serrated engagements 32 on male coupling 22. Serrated engagements 30 and 32 allow male coupling 22 to enter female coupling 24 but resist withdrawal of male coupling 22 from female coupling 24. Inwardly directed serrated engagements 30 on female coupling 24 and outwardly directed serrated engagements 32 on male coupling 22.

Figure 13:
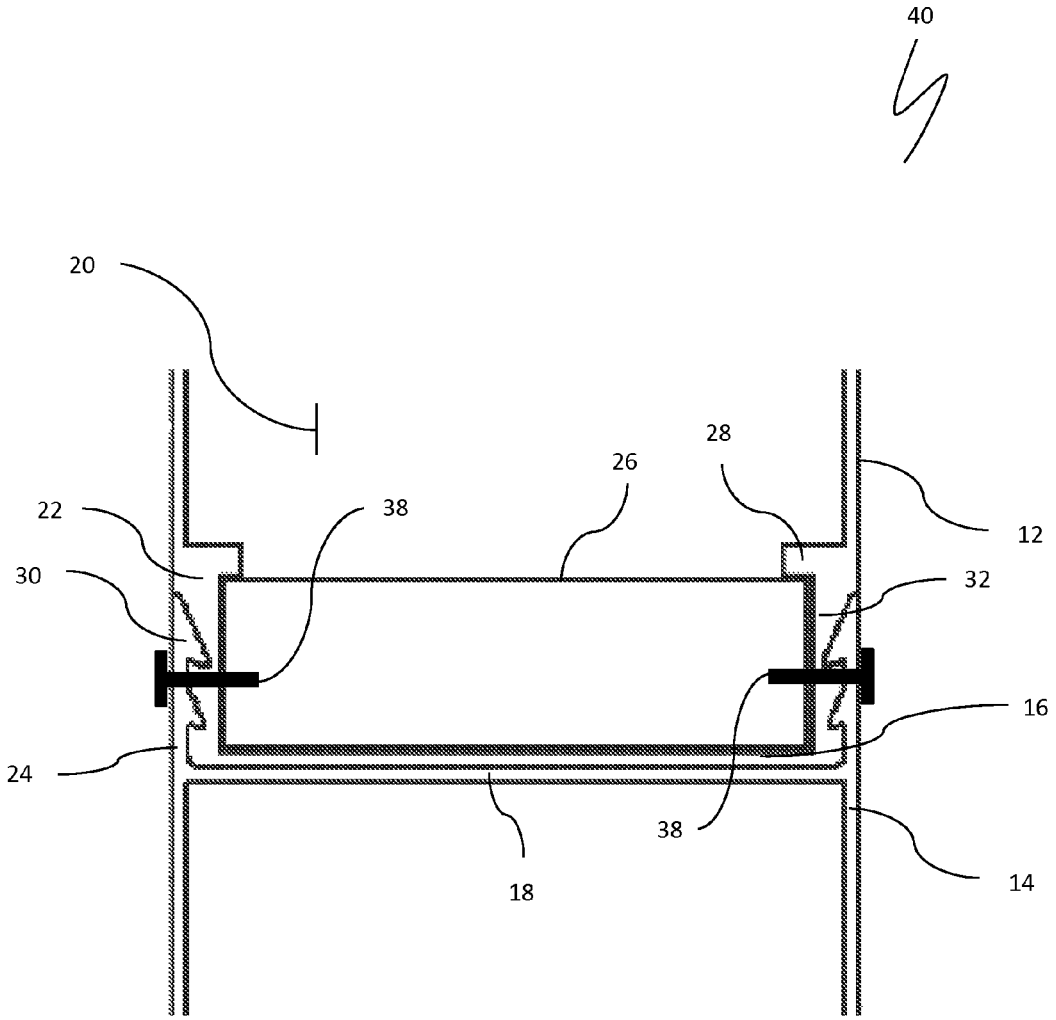
FIG. 13 is a side elevation view in section of a male to female connection with fasteners.

The fastening mechanism of the wall system 10 that hold the panels 12 together is an interlocking system that locks two panels 12 together. It involves a design similar to a tongue-in-groove connection, combined with principles of a plug and socket joint also. The "plug" end of the panel is the male coupling 22 where the structural stud 26 is inserted. The "socket" end of the panel is female coupling 24. Serrated engagements 30 on the inside of the full length of the female coupling 24 lock onto mating serrated engagements 32 the full length of the male coupling 22, holding it in place while the bonding agent sets. The bonding agent is applied along the male coupling 22 and female coupling 24, and 3 screws 38 are inserted through the outside layer of female coupling 24 wall and into structural stud 26 inside panel 12, as shown in FIG. 13.

Panel body 14 has a vertical height to suit the installation application, this is usually between 8 feet and 12 feet. Panel body 14 has a minimum thickness of 4 inches, but can be equal to the thickness of any size of stud, 6 inches, 8 inches, 10 inches, 12 inches, etc. Panel body 14 has a horizontal length determined by desired structural stud spacing with a maximum horizontal length of 24 inches. Typical stud spacing is 12 inches, 16 inches or 24 inches.

The thickness of the panel walls are ⅛ inch and the width between the walls are 5¾ inches. The total width of the panel wall is 6 inches. From the first end 16 of one interlocking panel 12 to the next, where another panel 12 would interlock, is 1 foot. The 1 foot panel 12 has additional vertical structural support to reinforce the panel 12 for lateral loads, such that a 1 foot wall panel 12 is separated into 3 columnar sections. When placing the panels 12 in place and securing the outwardly directed serrated engagements 32 and inwardly directed serrated engagements 30 together, a rubber hammer is used to prevent damage to the panel 12 or the outwardly directed serrated engagements 32 and inwardly directed serrated engagements 30. After the panels 12 are secured in placed, the interior cavities 20 are filled with a closed-cell extruded polystyrene foam insulation, such as STYROFOAM™. The panels 12 can be made either 8 feet or 9 feet tall. The 8 foot tall piece weighs 32 pounds without the structural stud 26 and insulation. The 9 foot tall piece weighs 36 pounds of PVC without the structural stud 26 and insulation.

Load bearing wall system 10 is made up of a plurality of interlocking panels 12 that may include straight sections, corners and bent sections. Panels 12 intended for straight sections have female coupling 24 opposed to male coupling 22 in a linear alignment. Panels 12 positioned where there is a corner or change in direction have hollow panel body 14 bent so that female coupling 24 is angularly offset from male coupling 22.

The design and variety of panels 12 can accommodate windows, 90 degree corners, chimneys box out, and Bay windows. It has the capacity to essentially provide the home builder any foundation specifications they would like. As well as 1 foot panels 40 (shown in FIG. 1), there are 90 degree corners 42 (shown in FIG. 4 and FIG. 5); 4" fillers 44 (shown in FIG. 3), 1½" fillers 46 (shown in FIG. 6), 45 degree corners 48 (shown in FIG. 2 and FIG. 11). It will be appreciated that fillers can be made in different sizes to accommodate dimensional requirements. In addition to 4" fillers 44 (shown in FIG. 3), 1½" fillers 46 (shown in FIG. 6) will be required to arrive at intended lengths. It will also be appreciated that different angular components may be required in addition to the 45 degree component illustrated. For example, it is not uncommon for designs to incorporate a 22.5 degree corner.

Closed-cell extruded polystyrene foam insulation fills the interior cavity 20 in the panel 12, this adds to the overall strength of the panel 12, and provides better insulation properties than traditional concrete foundation walls.

Figure 5:
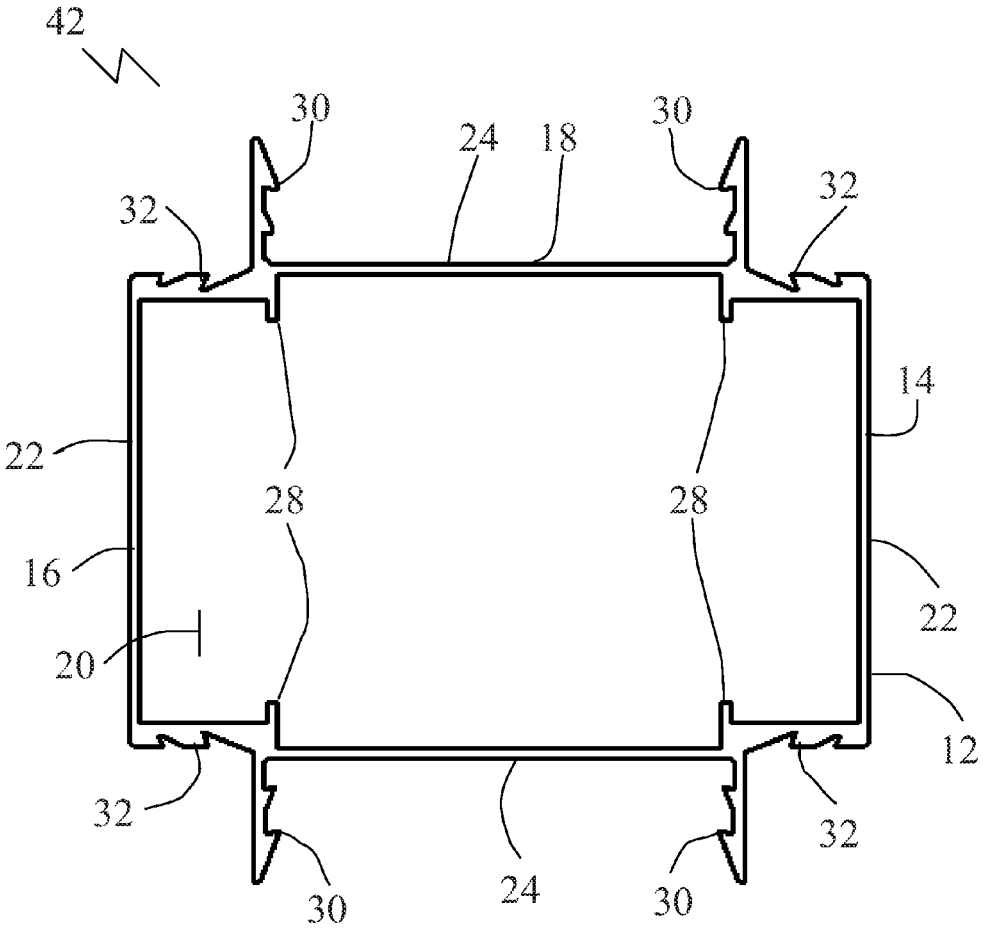
FIG. 5 is a four way connector panel.

Referring to FIG. 5, the 90 degree corner panel 42 is made for all 90 degree corners in a house as well as any center wall division. The 90 degree corner makes a 7½" panel containing a structural stud 26 and an insulation block. Although the measurements of the unit is 7½", the serrated engagements 30 and 32 measure 6" wide allowing a perfect fit into other panels 12 to make the foundation walls 10. It consists of a 6" square section, with the addition of two male couplings 22 on opposite sides of the square, as well as two female couplings 24, on the other two sides. The unit can work up to four intersection walls. For a 90 degree outside corner, two sides of the serrated engagements 30 and 32 (one male coupling 22 and female coupling 24) would be cut off to provide a complete 90 degree corner, with one female coupling 24 to connect to the end of one wall section, and a female coupling 22, to accommodate the attachment of the beginning of the next section of wall 10. As with the wall panel sections, there is enough room in the male coupling 22 for a structural stud 26 to be inserted.

Figure 6:
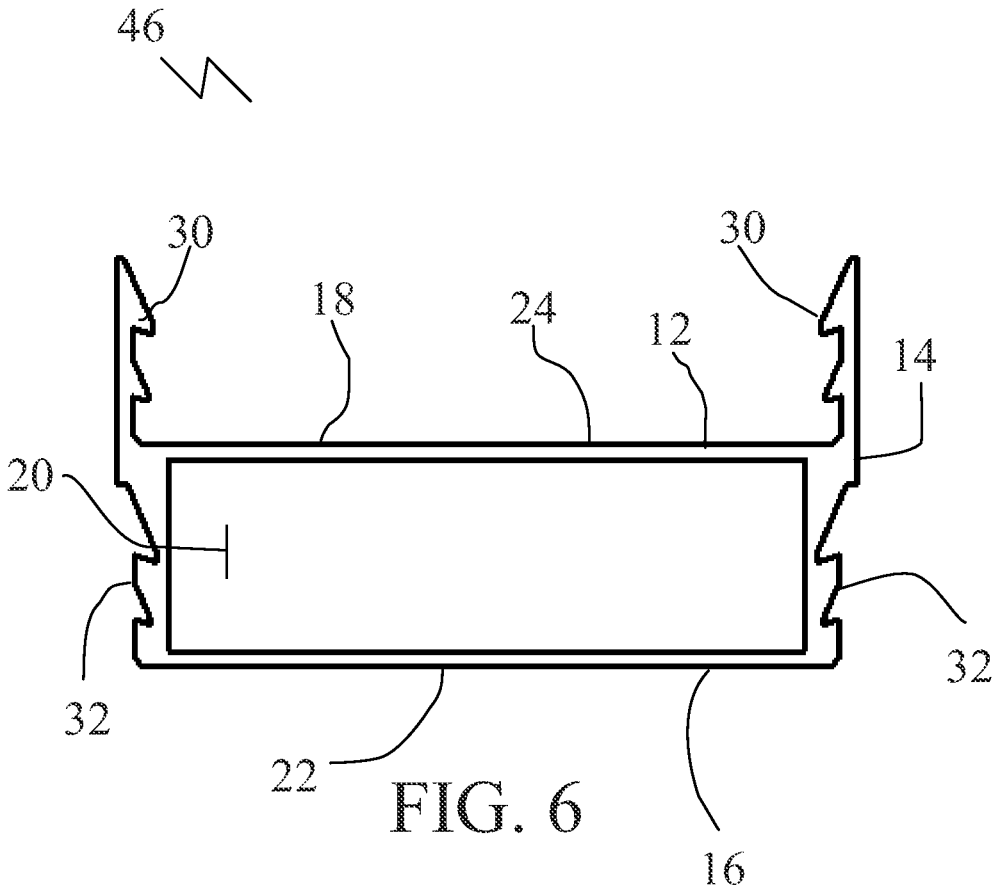
FIG. 6 is a filler interlocking panel.

The 4" filler panel 44 (shown in FIG. 3) and 1½" filler panel 46 (shown in FIG. 6) 12 are components of the wall system 10 that will allow the home builder to have a wall length multiples different than one foot. It can complete the walls 10 to the exact length that you require by adding these fillers together and can fit corners of any angle. Referring to FIG. 6, the 1½" filler panel 46 is used to complete the foundation walls at the exact length required with measurements of 3", 4½", 6", 7½", etc. This offers greater flexibility for home design. This filler measures 3" in length, including the interlocking joints 22 and 24 and the serrated engagements 32 on join panels together. The total space of this panel 46 is 1½" long thereby not allowing room for a 2×6 wood to fit inside the panel 46. Closed-cell extruded polystyrene foam insulation can be inserted inside the interior cavity 20 of filler for extra warmth and prevention of heat loss through the wall system 10.

Figure 3:
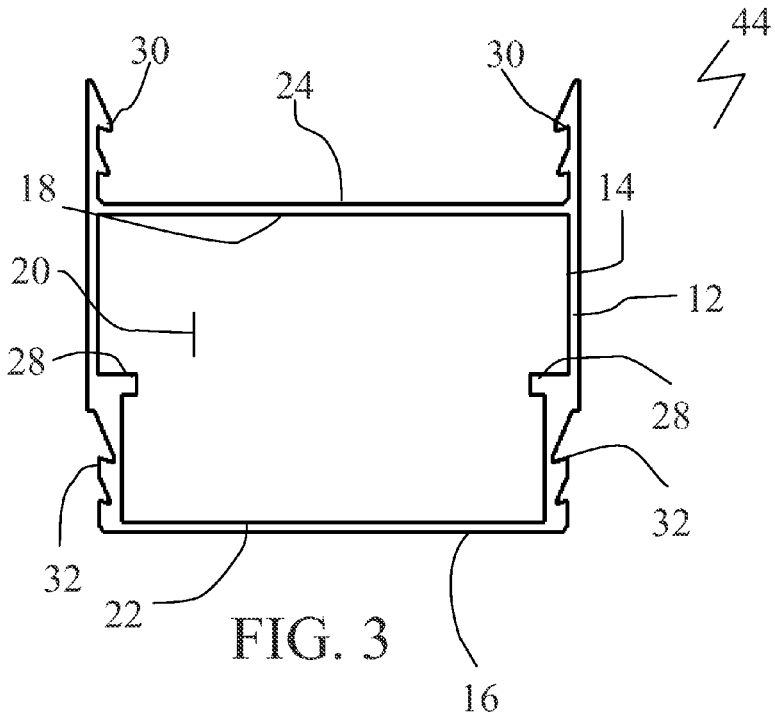
FIG. 3 is a truncated filler interlocking panel.
Figure 4:
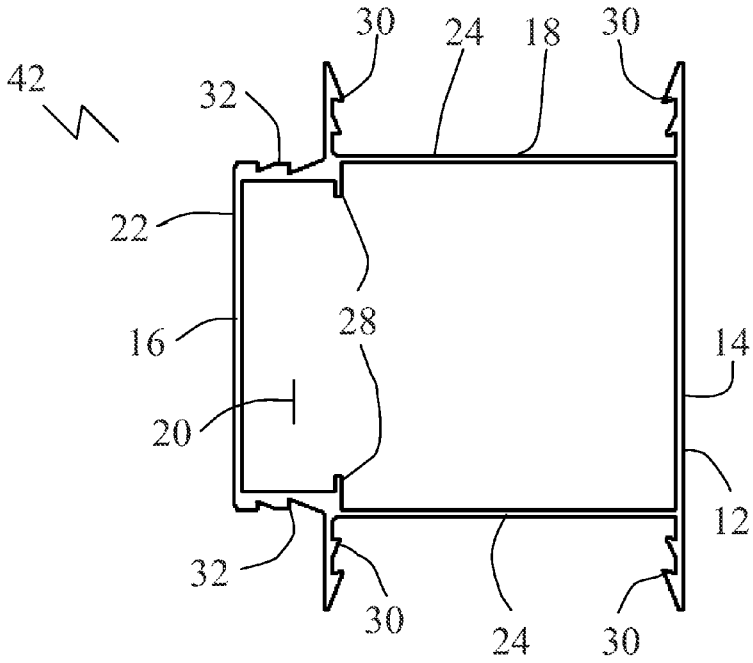
FIG. 4 is a three way connector panel.

Referring to FIG. 3, the 4" filler 44 is another option to use to compliment all of the other sizes of panel 12 pieces used in similar ways as the 1½" filler 36 without as many pieces. This 4" filler 44 is simply a smaller panel 12 that interlocks with other panels 12 of the foundation wall 10. The 4" filler panel 44 has the serrated engagement 32 inside the foundation wall 10 to insert the structural stud 26 and space is available for the insulation for added strength and prevention of heat loss. This filler contains the same serrated engagements 30 and 32 as the 1½" filler 46 and 1'0" panels 40. The width of this filler is 6". During the home building, different areas will require the 4" filler 44 and other areas the 1½" filler 46 will be more appropriate for flexibility and convenience. With the flexibility of these fillers, areas like bay windows are more attainable and easier to construct. The 1½" filler 46 (shown in FIG. 6) and 4" filler 44 (shown in FIG. 3) are a stronger foundation wall 10 than the 1'0" wall and adds strength and flexibility in constructing a home.

Figure 8:
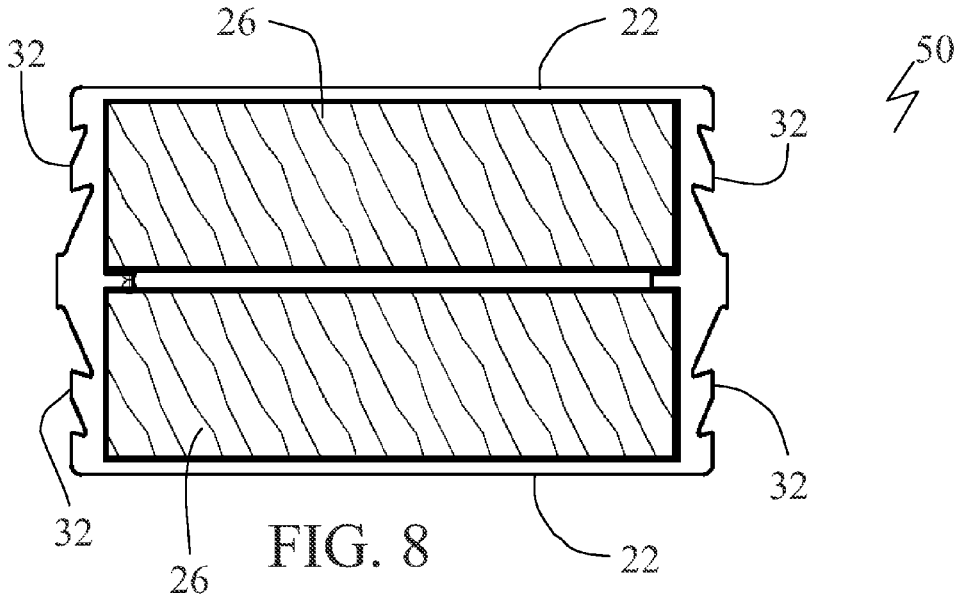
FIG. 8 is a panel end change from female to male.
Figure 9:
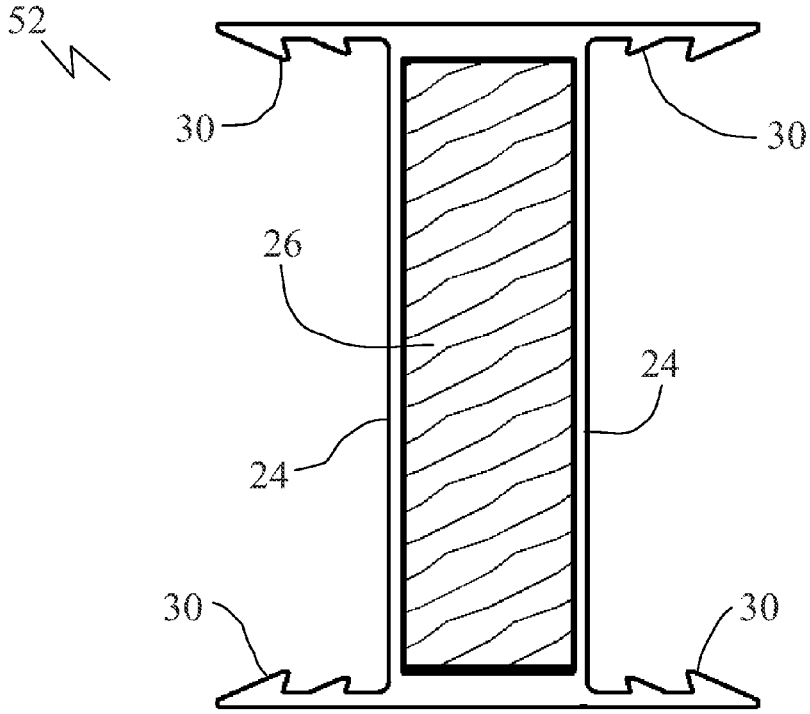
FIG. 9 is a long panel end change from male to female.
Figure 10:
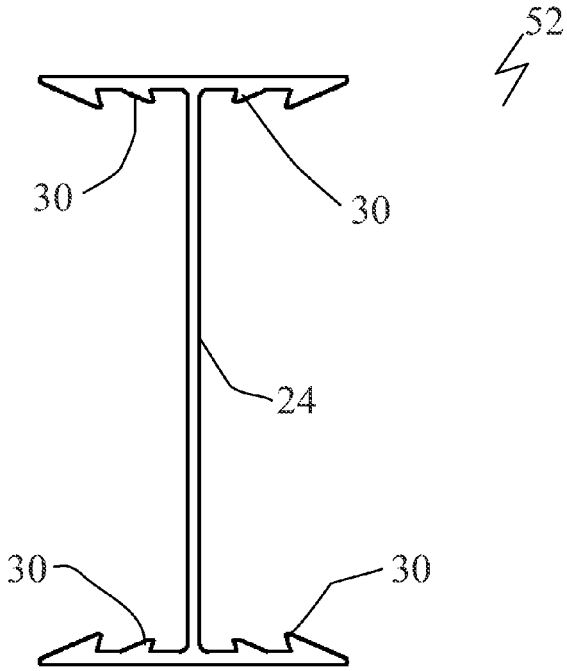
FIG. 10 is panel end change from male to female.
Figure 11:
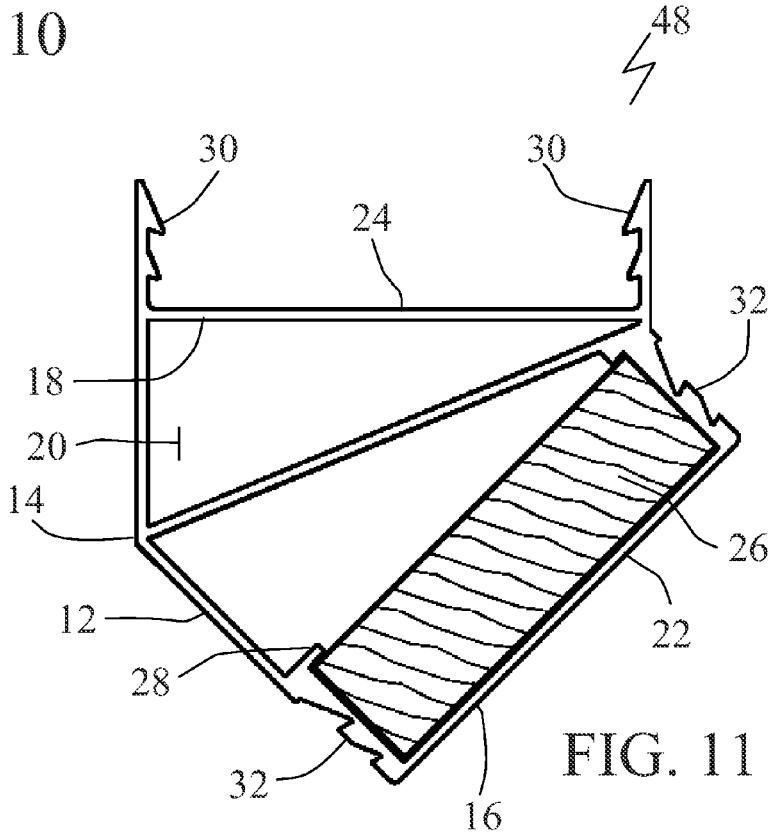
FIG. 11 is a short interlocking panel with at 45 degree corner bend.

Referring to FIG. 8 to FIG. 10, panel end changes 50 and 52 may be used to connect panels where adjacent couplings 22 or 24 are both the same. These panel end changes 50 and 52 allow for panels to be rotated as needed for proper fit without being limited by the type of coupling 22 or 24 to which they are to connect. Referring to FIG. 8, panel end change 50 has two male couplings 22 which allow it to connect panels with adjacent female couplings 2. Serrated engagements 32 on panel end change 50 connect with serrated engagements 30 on panels. Referring to FIG. 9 and FIG. 10, panel end change 52 has two female couples 24 which allow it to connect panels with adjacent male couples 22. Serrated engagements 30 on panel end change 52 connect with serrated engagements 32 on panels. Referring to FIG. 9, a long panel end change 52 may be used to add additional length to a panel or, referring to FIG. 10, a short panel end change 52 may be used to limit additional length of the panel.

Figure 12:
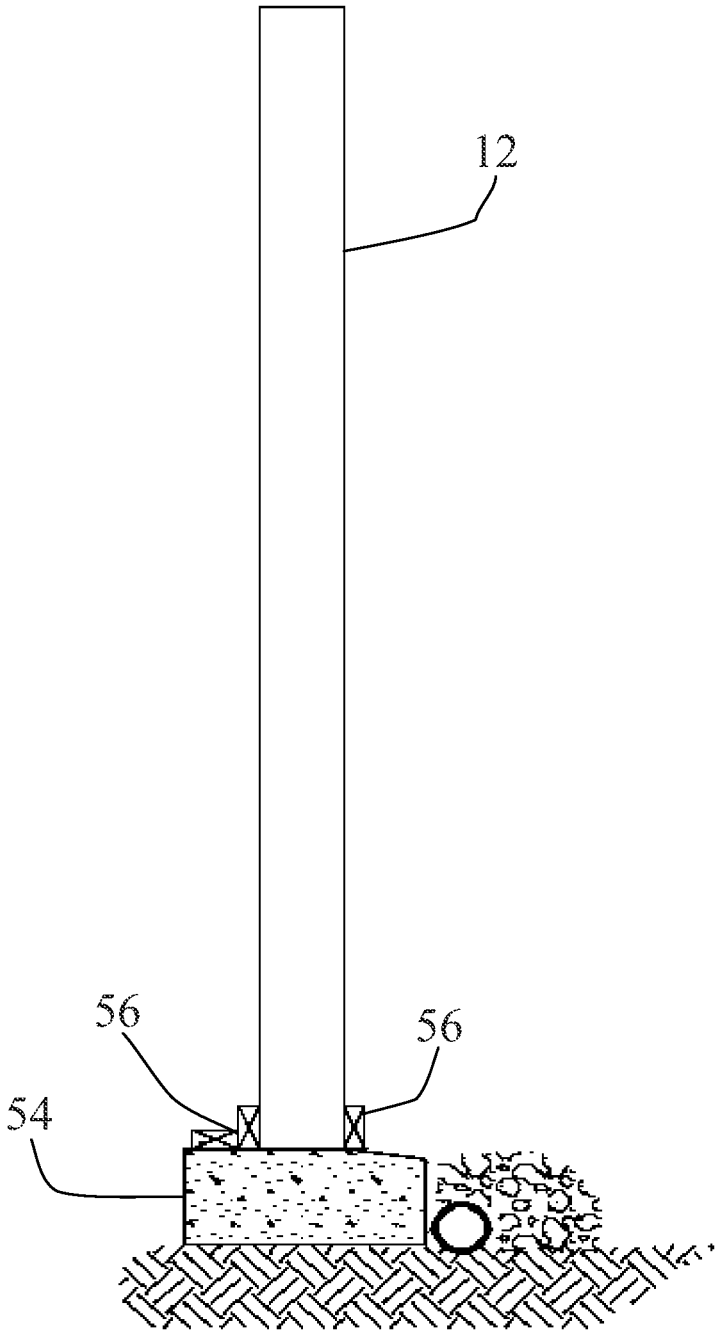
FIG. 12 is a side elevation view of an interlocking panel positioned on an underlying support.

Referring to FIG. 12, an underlying support 54 may be required in certain circumstances. For example, when wall system 10 is being constructed on an uneven surface, underlying support 54 provides a flat surface. If a flat surface is not available, panels 12 may not maintain proper connections with adjacent panels and result in a faulty wall once complete. Underlying support 54 may be made of 2×4 pressure treated lumber, crushed rock, gravel, sand, concrete or any other building material known in the art. Anchors 56 may be used to anchor panels 12 to underlying support 54.

Operation:

Referring to FIG. 1, primer is applied along the outwardly directed serrated engagements 32 and inwardly directed serrated engagements 30 of the locking system on either side of the panel. This primer cleans the panel 12 and also softens the panel 12 lightly so when the interlocking system 10 is connected, it can fit securely to become a strong unit. Glue is placed on top of the primer and just before the panels 12 are fitted together, a strip of butyl is placed down the center of the panel 12 where the interlocking systems join two panels 12 together. Butyl is a product purchased at Home Depot with a 50 year warranty that does not dry or crack making it ideal for preventing water penetration. The interlocking system locks so securely that water penetration from the ground surrounding the wall system 10 is lower than a concrete foundation. 2×6" treated wood is inserted in between the first end 16 of the panel 12 and the stops 28 designed to fit the structural stud 26 in place. It fits lengthwise across the panel 12 to increase the strength of the panel 12 and to allow a place where screws 38 can be fastened. Screws 38 are shown in FIG. 13. Once the panel 12 is joined with the interlocking system 10, it is secured by the joints of outwardly directed serrated engagements 32 and inwardly directed serrated engagements 30, and the primer and glue and butyl are in its place, the panels 12 can then be secured once again by 3 screws 38 fastened vertically down through the outwardly directed serrated engagements 32 and inwardly directed serrated engagements 30 and the structural stud 26 as shown in FIG. 13.

Test Results:

Individual panels from the load bearing wall system were subjected to independent third party testing. Two samples were tested: the walls of the hollow panel body of a first sample was 0.125 inches and the walls of the hollow panel body of a second sample was 0.25 inches.

The objective of the testing was to obtain load and displaconcrete data when each PVC panel was loaded in compression from end to end as well as in a three point bend.

The set-up for the end to end compression test consisted of a ten ton hydraulic ram and a reaction block attached to the vertical column. Each panel was installed in the vertical position between the hydraulic ram and the reaction block. The ends of the specimens were shimmed and a piece of ten test board was used to ensure even distribution of load through the beam. Load was calculated by multiplying the published area of the hydraulic cylinder and the measured hydraulic pressure. The displaconcrete was measured using a cable potentiometer transducer.

The ⅛" panel thickness reached a maximum axial load of 2939 lbs of force. Loading was stopped when the displaconcrete was increasing with little to no increase in axial load. The ¼" panel thickness reached a maximum axial load of 5012 lbs of force. Loading was stopped when the displaconcrete was increasing with little to no increase in axial load.

The three point bend test set-up consisted of a 10 ton hydraulic ram and a reaction block attached to C-FER's Strong Wall. The PVC panel was installed horizontally. Skated were used under each end of the PVC panel to allow for movement while loading. The PVC panel tested was 8 feet. The skated were positioned 6 inches from each end of the specimen. Load was applied to the center of the beam by pressing on a metal plate that was 7.5 inches wide by 12 inches long. As in the previous tests, the load was calculated by multiplying the published area of the hydraulic cylinder and the measured hydraulic pressure. The deflection was measured using a cable potentiometer transducer.

The 0.125 inch wall thickness beam (⅛" thick) reached a maximum load of 3048 lbs force before there was a drop in load of 500 lbs force. The load was removed and the PVC panel inspected. Load was then applied to the PVC panel again. A maximum load of 6159 lbs force was applied before there was a drop in load. The 0.25 inch wall thickness (¼" thick) PVC panel reached a maximum load of 6314 lbs force before a drop in load was observed.

A typical house will hold 1000 pounds per linear foot. Results from testing shows the Eco-Pro Foundation Walls can hold more than 6 times the weight of a typical house at ¼" wall thickness.

The PVC is very strong and durable, tests were performed using full force of a grown man and the PVC was not altered in any way after hitting with a hammer consistently.

Advantages:

It is believed that the load bearing wall system described presents a viable alternative to concrete in rural areas where concrete is either not readily available or is inordinately expensive.

The wall system is more suitable in many situations since the walls are made of PVC, which allows backfill to occur immediately after installation. There are no delays as there is in concrete foundation walls as there is a 28 day period needed to cure the concrete before backfilling. There is also no need to tar the foundation as is practiced in concrete walls because butyl is applied in interlocking joints. The PVC wall eliminates the need for rebar or concrete or a pump to pour out the foundation. Very few, if any, trades people are required for installation and the oil that is applied on wood panels to ease removal after concrete is poured is eliminated. The PVC walls are more environmentally friendly with fewer resources utilized and expended.

There is less energy loss with the PVC foundation walls than with a concrete foundation. The PVC foundation wall has a higher R value. The concrete foundation transfers cold through the wall to the inside of the house. A PVC foundation wall does not act as a concrete foundation does, as the insulation is installed directly into the foundation wall so there is very little cold transferred into the basement of a house.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A load bearing wall system, comprising:

a plurality of interlocking panels, each panel comprising:

a hollow panel body having a first end, a second end and an interior cavity, the hollow panel body being formed from an extruded plastic;

a male coupling at the first end, the male coupling being extruded to form a stud cavity that is sized to house a structural stud, the structural stud being inserted into the stud cavity such that the stud is completely encompassed by the hollow panel body, the structural stud extending for the entire vertical height of the panel body;

a female coupling at the second end, the female coupling being capable of rigidly interlocking with the male coupling of another of the plurality of interlocking panels;

the panel body having a vertical height, a minimum width of 4 inches and a horizontal length determined by desired structural stud spacing with a maximum length of 24 inches.

2. The load bearing wall system of claim 1, wherein the interior cavity of the hollow panel body has at least one transverse internal cross-brace.

3. The load bearing wall system of claim 1, wherein the interior cavity of the hollow panel body is filled with insulation.

4. The load bearing wall system of claim 1, wherein those of the plurality of interlocking panels intended for straight sections having the female coupling opposed to the male coupling in a linear alignment, and those of the plurality of interlocking panels positioned where there is a corner or change in direction having the hollow panel body bent so that the female coupling is angularly offset from the male coupling.

5. The load bearing wall system of claim 1, wherein fasteners are driven through the female coupling and male coupling into the structural stud to secure the male coupling and female coupling in mating engagement.

6. The load bearing wall system of claim 1, wherein inwardly extending stops are positioned between the male coupling and the interior cavity to preclude movement of the structural stud.

7. The load bearing wall system of claim 1, wherein the structural stud is one of a 2×6, 2×8, or a 2×10.

8. The load bearing wall system of claim 3, wherein the insulation is foam insulation.

9. The load bearing wall system of claim 1, wherein the female coupling has a plurality of inwardly directed serrated engagements and the male coupling has a plurality of outwardly directed serrated engagements, the respective serrated engagements allowing the male coupling to enter the female coupling, but resisting the withdrawal of the male coupling from the female coupling.

10. The load bearing wall system of claim 9, wherein the respective serrated engagements on the male coupling and the female coupling form a water resistant seal.

11. The load bearing wall system of claim 1, wherein the hollow panel body is made of polymer plastic.

12. The load bearing wall system of claim 1, wherein the male connector has a solid front face at a distal end that forms a front face of the stud cavity and that provides structural support to the male connector.

13. A load bearing wall system, comprising:

a plurality of interlocking panels, each panel comprising:

a hollow panel body having a first end, a second end and an interior cavity;

a male coupling at the first end, the male coupling housing a structural stud that extends for the entire vertical height of the panel body;

a female coupling at the second end, the female coupling being capable of interlocking with the male coupling of another of the plurality of interlocking panels;

the panel body having a vertical height, a minimum width of 4 inches and a horizontal length determined by desired structural stud spacing with a maximum length of 24 inches;

wherein those of the plurality of interlocking panels intended for straight sections having the female coupling opposed to the male coupling in a linear alignment, and those of the plurality of interlocking panels positioned where there is a corner or change in direction having the hollow panel body bent so that the female coupling is angularly offset from the male coupling.

14. A load bearing wall system, comprising:

a plurality of interlocking panels, each panel comprising:

a hollow panel body having a first end, a second end and an interior cavity;

a male coupling at the first end, the male coupling housing a structural stud that extends for the entire vertical height of the panel body;

a female coupling at the second end, the female coupling being capable of interlocking with the male coupling of another of the plurality of interlocking panels;

the panel body having a vertical height, a minimum width of 4 inches and a horizontal length determined by desired structural stud spacing with a maximum length of 24 inches;

wherein the female coupling has a plurality of inwardly directed serrated engagements and the male coupling has a plurality of outwardly directed serrated engagements, the respective serrated engagements allowing the male coupling to enter the female coupling, but resisting the withdrawal of the male coupling from the female coupling.

15. The load bearing wall system of claim 14, wherein the respective serrated engagements on the male coupling and the female coupling form a water resistant seal.

* * * * *

UNITED STATES PATENT AND TRADEMARK OFFICE

CERTIFICATE OF CORRECTION

PATENT NO. : 8,640,410 B2
APPLICATION NO. : 13/754523
DATED : February 4, 2014
INVENTOR(S) : Y. Bergeron It is certified that error appears in the above-identified patent and that said Letters Patent is hereby corrected as shown below:

| COLUMN | LINE | ERROR |
|---|---|---|
| item (30) Title Pg. 1, col. 1 | Foreign Appln. Priority Data | Before the line beginning with "(51) Int. Cl." please insert: --(30) Foreign Application Priority Data Jan. 30, 2012 Canada 2766628-- |

Signed and Sealed this
Thirtieth Day of September, 2014

Michelle K. Lee

Michelle K. Lee
*Deputy Director of the United States Patent and Trademark Office*